US009297532B2

(12) United States Patent
Wasif et al.

(10) Patent No.: US 9,297,532 B2
(45) Date of Patent: Mar. 29, 2016

(54) CAN ANNULAR COMBUSTION ARRANGEMENT WITH FLOW TRIPPING DEVICE

(71) Applicant: Siemens Aktiengesellschaft, Munich (DE)

(72) Inventors: Samer P. Wasif, Oviedo, FL (US); Juergen Meisl, Muelheim an der Ruhr (DE); Bertram Janus, Muelheim an der Ruhr (DE); Andreas Koch, Oberhausen (DE)

(73) Assignee: Siemens Aktiengesellschaft, München (DE)

( * ) Notice: Subject to any disclaimer, the term of this patent is extended or adjusted under 35 U.S.C. 154(b) by 386 days.

(21) Appl. No.: 13/691,947

(22) Filed: Dec. 3, 2012

(65) Prior Publication Data

US 2013/0160423 A1 Jun. 27, 2013

Related U.S. Application Data

(60) Provisional application No. 61/578,444, filed on Dec. 21, 2011.

(51) Int. Cl.

| | |
|---|---|
| ***F23R 3/02*** | (2006.01) |
| ***F23R 3/26*** | (2006.01) |
| ***F23R 3/54*** | (2006.01) |
| ***F23R 3/00*** | (2006.01) |
| ***F23R 3/46*** | (2006.01) |

(52) U.S. Cl.

CPC . *F23R 3/26* (2013.01); *F23R 3/002* (2013.01); *F23R 3/02* (2013.01); *F23R 3/46* (2013.01); *F23R 3/54* (2013.01); *F05B 2260/222* (2013.01); *F05B 2260/2241* (2013.01); *F23R 2900/03045* (2013.01)

(58) Field of Classification Search

CPC ..... F23R 3/002; F23R 3/26; F23R 3/46; F23R 3/54; F23R 3/50; F23R 3/283; F23R 2900/03045; F05B 2260/222; F05B 2260/2241

See application file for complete search history.

(56) References Cited

U.S. PATENT DOCUMENTS

| | | | | |
|---|---|---|---|---|
| 3,879,939 | A * | 4/1975 | Markowski | 60/751 |
| 4,129,985 | A | 12/1978 | Kajita et al. | |
| 5,081,843 | A * | 1/1992 | Ishibashi et al. | 60/733 |
| 5,327,718 | A * | 7/1994 | Iwata et al. | 60/773 |
| 5,349,812 | A * | 9/1994 | Taniguchi et al. | 60/39.23 |
| 5,431,017 | A * | 7/1995 | Kobayashi et al. | 60/723 |
| 5,513,982 | A * | 5/1996 | Althaus et al. | 431/350 |
| 5,533,329 | A * | 7/1996 | Ohyama et al. | 60/773 |
| 5,623,819 | A * | 4/1997 | Bowker et al. | 60/776 |

(Continued)

FOREIGN PATENT DOCUMENTS

| | | |
|---|---|---|
| CN | 101858596 A | 10/2010 |
| EP | 2226564 A | 12/1978 |
| EP | 2372248 A2 | 10/2011 |

*Primary Examiner* — Phutthiwat Wongwian
*Assistant Examiner* — Rene Ford

(57) ABSTRACT

A can annular combustion arrangement (12) for a gas turbine engine (10), including: a combustor can (14) having an inlet (46) at a head end (62); an annular chamber (30) surrounding the combustor can (14) for delivering a flow of compressed air from a plenum (18) to the inlet (46); a fuel injector (49) configured to inject a flow of fuel into the flow of compressed air; and a flow tripping device (60) surrounding the combustor can (14) and disposed in the annular chamber (30) downstream of the fuel injector (49).

16 Claims, 3 Drawing Sheets

(56) References Cited

U.S. PATENT DOCUMENTS

| | | | | |
|---|---|---|---|---|
| 5,658,358 | A * | 8/1997 | Chyou et al. | 48/180.1 |
| 5,692,370 | A * | 12/1997 | Stuhlmuller et al. | 60/39.23 |
| 7,249,461 | B2 * | 7/2007 | Moraes | 60/796 |
| 7,302,802 | B2 * | 12/2007 | Alkabie | 60/772 |
| 2002/0005274 | A1 * | 1/2002 | Beeck et al. | 165/109.1 |
| 2010/0005804 | A1 * | 1/2010 | Chen et al. | 60/752 |
| 2010/0018209 | A1 * | 1/2010 | Ramier et al. | 60/740 |
| 2010/0071377 | A1 * | 3/2010 | Fox et al. | 60/740 |
| 2010/0136496 | A1 * | 6/2010 | Kashihara | F23R 3/343 431/285 |
| 2010/0186416 | A1 | 7/2010 | Chen et al. | |
| 2011/0016869 | A1 * | 1/2011 | Iwasaki | F23R 3/005 60/752 |
| 2011/0023494 | A1 * | 2/2011 | Butler et al. | 60/748 |
| 2011/0225947 | A1 * | 9/2011 | Lacy et al. | 60/39.23 |
| 2012/0055165 | A1 * | 3/2012 | Roldan-Posada | 60/755 |
| 2012/0102916 | A1 * | 5/2012 | Bunker | 60/247 |
| 2012/0304654 | A1 * | 12/2012 | Melton et al. | 60/746 |
| 2013/0091848 | A1 * | 4/2013 | Manoharan et al. | 60/752 |

* cited by examiner

CAN ANNULAR COMBUSTION ARRANGEMENT WITH FLOW TRIPPING DEVICE

This application claims benefit of the 21 Dec. 2011 filing date of U.S. provisional patent application No. 61/578,444 which is incorporated by reference herein.

FIELD OF THE INVENTION

The invention relates to manipulating compressed air flowing toward a combustor inlet in a gas turbine engine with a can annular combustion arrangement. In particular, the invention relates to a flow tripping device disposed in an annular flow chamber surrounding a combustor can.

BACKGROUND OF THE INVENTION

Gas turbine engines with can annular combustion arrangements have compressors that deliver compressed air to the combustion arrangement. The compressed air exits the compressor through a diffuser and enters a plenum from which the combustion arrangement draws the compressed air. The plenum is bounded on an outside by a combustion section casing. A top hat arrangement including a plurality of top hats and associated portals may be used as part of the combustion section casing. Top hat arrangements provide discrete radially extending chambers that enclose at least portions of respective combustor cans. The discrete combustor cans feed respective and discrete transition ducts which ultimately terminate immediately upstream of a first row of turbine blades of a turbine section. Each top hat arrangement thus forms an outer boundary of a respective annular chamber with an inner boundary formed by a respective combustor can and/or transition duct.

In a typical premix can annular combustor, a pilot burner is centrally disposed in the combustor can and is surrounded by a symmetrically disposed plurality of premix burners. While the structure of the combustor is symmetrical about its flow axis, compressed air entering the combustor can inlet may not be evenly distributed circumferentially due to the convoluted path taken by the air from the compressor to the combustor inlet, and each premix burner may be receiving a different amount of compressed air, yet each premix burner may be delivering the same amount of fuel. Consequently, fuel to air ratios may vary from one premix burner to another. In addition, air entering each burner may have varying local turbulence. Further, these parameters may change with changing power output, and/or changing ambient weather conditions, which vary the density and moisture of air entering the compressor, which effect aerodynamics of the air traveling to the combustor can inlet.

Various approaches have been taken to condition the air entering the combustor can inlet in order to accommodate these factors, such as by using airfoils as disclosed in U.S. Pat. No. 4,129,985 to Kajita et al. However, none of these approaches appears to have completely resolved the problem. As a result, there remains room in the art for improvement.

BRIEF DESCRIPTION OF THE DRAWINGS

The invention is explained in the following description in view of the drawings that show.

DETAILED DESCRIPTION OF THE INVENTION

The present inventors have discovered a novel way to reduce harmful emissions in a can annular combustor such as may be used in a gas turbine engine. The inventors have discovered that an arcuate shaped, circumferentially extending flow tripping device placed in the annular chamber surrounding a combustor can and/or transition will normalize the airflow across the combustor inlet, thereby making the combustion flame more uniform and reducing the amount of pilot burner flame needed to stabilize combustion, which in turn results in reduced emissions.

Figure 1:
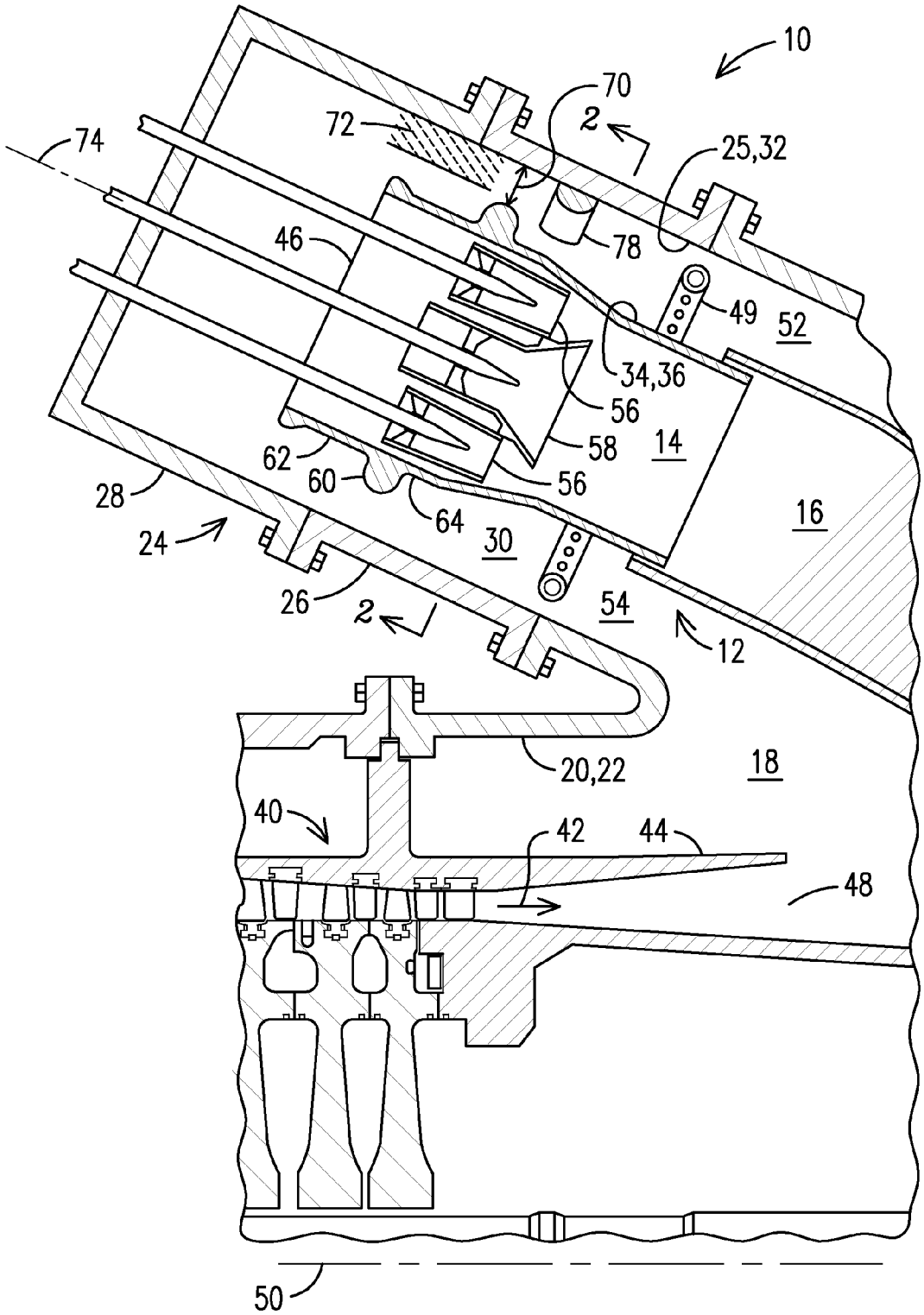
FIG. 1 is a partial cross sectional view of an exemplary embodiment of a gas turbine engine having a flow tripping device.

FIG. 1 is a partial cross sectional view of an exemplary embodiment of a gas turbine engine 10 in accordance with the present invention and having a can annular gas combustion arrangement 12 including a combustor can 14 and transition duct 16. At least part of the transition duct 16 is disposed within a plenum 18 formed within a combustion section casing 20. Individual combustor cans 14 extend through an annular portion 22 of the combustion section casing 20 where each combustor can 14 is surrounded by a top hat arrangement 24 including an individual portal 26 and an associated top hat 28. The top hat arrangement 24 surrounds at least part of the combustor can 14 and forms an annular chamber 30, where an inner surface 25 of the top hat arrangement 24 defines an outer boundary 32 of the annular chamber 30, and an outer surface 34 of the combustor can 14 defines an inner boundary 36 of the annular chamber. A cross section of the annular chamber 30 need not have perfectly circular inner and outer boundaries; only the general shape of a cross section of the annular chamber need be generally annular. Further the cross section of the annular chamber may change diameter along a direction of the flow of compressed air.

The gas turbine engine 10 includes an axial compressor 40 that delivers compressed air in an axial direction 42 with respect to a gas turbine engine longitudinal axis 50. A diffuser 44 receives the axially flowing compressed air, diffuses it, and delivers it to the plenum 18. Air exiting the diffuser must ultimately enter a combustor can inlet 46 immediately prior to being used in the combustion process. However, the combustor can inlet 46 is radially outward of and rearward of (closer to the compressor than) a diffuser outlet 48 with respect to the gas turbine engine longitudinal axis 50. Consequently, within the plenum 18 the air must rotate so that it travels radially outward from and then rearward with respect to the gas turbine engine longitudinal axis 50. The compressed air must also travel around aerodynamic obstructions such as the transition duct 16 before working its way to the annular chamber 30. Within the annular chamber 30 there exist further aerodynamic obstructions. In an exemplary embodiment, for example, the combustion arrangement 12 may include a fuel injector 49 disposed in the annular chamber 30. The fuel injector 49 injects fuel into the compressed air flow to provide a premixed fuel and air mixture that enters the combustor can inlet 46. Various other structural (i.e. piping, struts etc) aerodynamic obstructions are likely to be present as well.

As a result of the direction changes and aerodynamic obstructions, instead of a uniform flow existing throughout a circumference of the annular chamber 30, the flow is more likely to vary in flow rate, turbulence, air density, and extent of mixing of the fuel from the fuel injector 49 with the air, etc. For example, momentum of the air exiting the diffuser outlet 48 is likely to result in more air mass flowing in a heavy flow region 52 of the annular chamber 30, while a lighter flow region 54 is likely to see lighter mass flow. This pattern may continue all the way to the combustor can inlet 46. Consequently, burners 56 proximate the heavy flow region 52 are likely to receive, and hence deliver, a greater amount of air mass than are burners 56 proximate the lighter flow region 54. If the circumferentially disposed burners 56 are delivering different amounts of air yet provide the same amount of fuel, the fuel/air mixture will vary between burners, and a combustion flame in the downstream combustion zone will not be uniform, but instead, for example, will be leaner downstream of the burners delivering more air, and richer downstream of burners delivering less air. The lean sections of the flame may be less stable, and hence more stabilizing assistance from the pilot burner 58 is needed. While the pilot burner only uses a low percentage of the total fuel going to the combustor can, up to approximately 30-70% of the emissions are associated with the pilot burner. The present invention reduces this asymmetry, and consequently, a reduction in emissions is possible.

This improvement is achieved with a flow tripping device 60 disposed in the annular chamber 30. In one exemplary embodiment, not meant to be limiting, the flow tripping device 60 may be annular and connected to a combustor basket head end 62 or a combustor basket downstream end 64. In an alternate exemplary embodiment the flow tripping device may be a flange that connects the head end 62 to the downstream end 64. In other exemplary embodiments the flow tripping device 60 may be positioned anywhere along a length of the annular chamber 30.

The flow tripping device 60 serves as an obstruction to air flow and as such, it generates some pressure loss in the compressed air flow. Prior art gas turbine engines are typically designed to avoid such pressure losses whenever possible, since they adversely affect the overall efficiency of the engine. The present inventors have purposefully and innovatively located the flow tripping device 60 at this location in spite of the resulting pressure loss, finding that the resulting decrease in harmful emissions (10-20% in one exemplary embodiment) is commercially more valuable than the small increase in pressure loss.

The flow tripping device 60 narrows the annular chamber to a gap 70 through which the compressed air can flow. It can be seen that in the exemplary embodiment of FIG. 1, an axial extension 72 of the gap 70 is unobstructed by any aerodynamically significant structure. Specifically, in the exemplary embodiment, the inner surface 25 of the top hat arrangement 24 does not taper inwardly in a downstream direction between the flow tripping device 60 and the combustor can inlet 46. However, in the exemplary embodiment of FIG. 1, the inner boundary 36 does increase in diameter at the inlet 46 without projecting into the region of the axial extension 72.

The flow tripping device 60 is arcuate in shape and extends circumferentially. It may be disposed on the outer surface 34 of the combustor can 14 and extend radially outward with respect to a combustor can longitudinal axis 74. Alternately, it may be disposed on the inner surface 25 of the top hat arrangement 24 and extend radially inward with respect to a combustor can longitudinal axis 74, and as such it will conform to those surfaces.

In an exemplary embodiment, the flow tripping device may be disposed within the annular chamber 30 downstream in the flow of compressed air of any other openings in the combustor can 14, such as openings for Helmholz resonators (not shown) and/or cooling openings, and upstream of the combustor can inlet 46. In exemplary embodiments with the fuel injector 49, the flow tripping device may also be located downstream thereof. In another exemplary embodiment the flow tripping device 60 may be disposed closer to the inlet than to an outlet of the combustor can. Further, when multiple flow tripping devices are used, the flow tripping devices may be at different locations with respect to the combustor can longitudinal axis 74. For example, in an exemplary embodiment a second flow tripping device 78 may be disposed more upstream with respect to the combustor can longitudinal axis 74 as well as with respect to the flow of compressed air in the annular chamber 30. It may also be disposed in the heavy flow region 52, and may extend from the inner surface 25 of the top hat arrangement 24.

The exact mechanism that causes the improvement in harmful emissions is not fully understood, and the inventors do not wish to be bound by a particular theory. However, when the flow tripping device 60 is used, the combustion flame is more stable, and thus the amount of assistance needed from the pilot flame decreases, and hence emissions decrease. One theory considered is that the flow tripping device 60 may direct more of the premixed fuel/air into the center of the combustor and therefore into the pilot burner, and this may increase the stability of the flame. This may be the result of any of several possible factors. A first factor may be eddies created by the flow tripping device 60 which force the air radially outward so that when the air reaches the turning region it may arc more toward the center of the combustor can. A second factor may be a result of a reduction in adherence of the compressed air flow to the surface of the combustor. Such adherence is greater in laminar flow than in turbulent flow, and by increasing the turbulence, the flow may not "stick" so the surface as much when it reaches the turning region, allowing it to travel further past the combustor can inlet before turning to enter, and this extra distance, together with a reduced desire to adhere to the inner surface of the combustor can, may be enough to permit the turning flow to travel further radially inward to the pilot burner. A third factor possibly contributing to the compressed air "overshooting" the combustor can inlet is an increased momentum imparted to the compressed air as it passes through the venturi between the flow tripping device 60 and the opposed surface 25, which accelerates the compressed air. It is also theorized that, in the case of a combustion arrangement including a C-stage fuel injector in the annular chamber, the pre-mixing of the C-stage fuel and air is very thorough, and adding this fully premixed fuel/air mixture to the pilot burner's own less-completely premixed fuel/air mixture may contribute to the emissions reduction.

Another theory is that the flow tripping device 60 may provide a choke point of sorts, resulting in a redistribution of the flow more uniformly around a circumference of the annular chamber 30. This in turn creates a more uniform flow (circumferentially) into the combustion can inlet, which provides more uniform flow to each of the premix burners, and a more uniform flow into the pilot burner, and therefore a more uniform flame. Since flame stability is limited by the most lean portion of a pre-mixed air-fuel mixture, having a more uniform flame may allow the overall mixture to be made somewhat leaner within stability limits, thereby resulting in lower emissions.

A further theory is that, for combustion arrangements including a C-stage fuel injector, such as a ring, within the annular chamber 30, the flow tripping device 60 may more uniformly mixes the fuel in the compressed air flow upstream of the inlet 46. It is thought that several of these theories may be correct, and/or that yet other phenomena are at work.

Regardless of the exact underlying mechanism, the more stable flame enabled by the flow tripping device 60 requires less help from the pilot burner, and thus the role of the pilot burner may be reduced, and the overall emissions of the burner reduced accordingly. All this is accomplished using a device that causes a pressure drop in the flow of compressed air within the annular chamber 30, which heretofore has been considered undesirable. Thus, using the flow tripping device 60 as disclosed is counter-intuitive.

Figure 2:
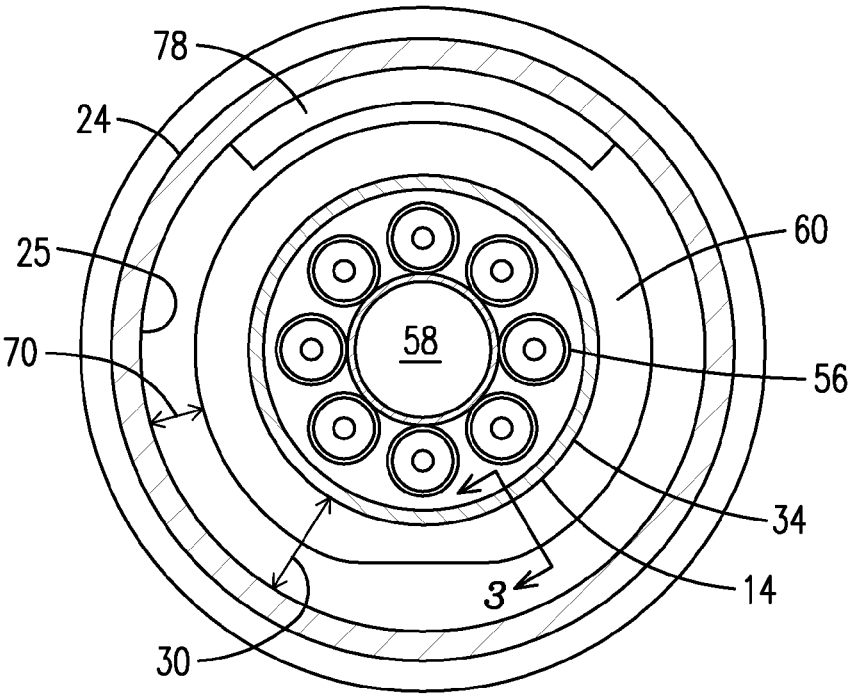
FIG. 2 is a cross section along line 2-2 of FIG. 1.

FIG. 2 shows a cross section along line 2-2 of FIG. 1. The annular chamber 30 can be seen as defined by the inner surface 25 of the top hat arrangement 24 and the outer surface 34 of the combustor can 14. In this exemplary embodiment, the flow tripping device 60 shown is fully annular, and leaves a gap 70 between the flow tripping device 60 and the inner surface 25 of the top hat arrangement 24. In one exemplary embodiment the flow tripping device may extend from the surface upon which it is mounted into the flow at least twenty percent of the way to the other surface defining the annular chamber 30. This can be seen in the exemplary embodiment of FIG. 2, where the flow tripping device 60 extends radially outward, and alternately, where the second flow tripping device 78 extends radially inward. In an alternate exemplary embodiment the flow tripping device may extend from the surface upon which it is mounted at least thirty percent of the way to the other surface defining the annular chamber 30. In yet another exemplary embodiment the flow tripping device may extend from the surface upon which it is mounted at least half way to the other surface defining the annular chamber 30.

For an exemplary embodiment where the flow tripping device is ring shaped and is mounted such as flow tripping device 60 such that it extends radially outward, when the flow tripping device 60 has a height of 20% of that of the annular chamber (i.e. extends twenty percent of the way out from a radially inner surface), the flow tripping device will reduce the annular chamber to a gap 70 having a cross sectional area not more than approximately 85% of the cross sectional area of the annular chamber 30 without the flow tripping device 60. For an exemplary embodiment where the flow tripping device 60 is ring shaped, extends radially outward, and has a height of 30% of that of the annular chamber, the flow tripping device will reduce the annular chamber to a gap 70 having a cross sectional area not more than 77% of the cross sectional area of the annular chamber 30 without the flow tripping device 60. For an exemplary embodiment where the flow tripping device extends radially outward, is ring shaped, and has a height of 50% of that of the annular chamber, the flow tripping device will reduce the annular chamber to a gap 70 having not more than 58% of the cross sectional area of the annular chamber 30 without the flow tripping device 60. The percentages given are examples only and are not meant to be limiting. Any percentage can be used so long as it is effective to properly condition the flow to the combustor inlet 46. In exemplary embodiments where the flow tripping device extends radially inward, the area of the remaining gap will be slightly less than those given above for the radially outward extending flow tripping devices because an area of the gap 70 occupied by a radially inwardly extending flow tripping device will be greater.

Likewise, in exemplary embodiments where the flow tripping device extends circumferentially for only a portion of a circumference of the annular chamber 30, for example, 90 degrees, or ¼ the circumference, then the portion of the annular chamber in which the flow tripping device is disposed (i.e. the portion delimited by the ends of the flow tripping device 60), the flow tripping device will reduce that portion of the annular chamber to a gap 70 that is a percentage of the annular chamber 30 without the flow tripping device 60. The flow tripping device 60 may extend radially by differing amounts at different circumferential locations. For example, in a ring shaped embodiment the flow tripping device 60 may extend radially further, resulting in a smaller gap 70, in the heavy flow region 52. In circumferential locations away from the heavy flow region 52 the flow tripping device 60 may extend less. In this manner various levels of flow tripping and restriction can be accomplished at different circumferential locations with a single flow tripping device 60.

Figure 3:
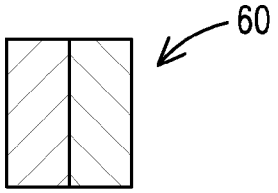
FIGS. 3-5 are alternative cross sections as would be seen along line 3-3 of FIG. 2 in various alternative embodiments.
Figure 4:
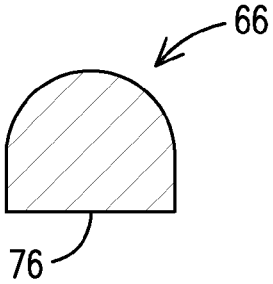
Figure 5:
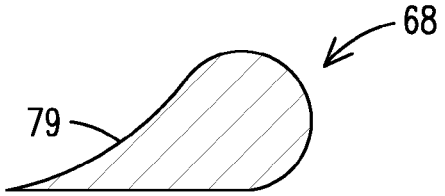

The flow tripping device 60 may have various cross sectional shapes along line 3-3 as shown in FIGS. 3-5. For example, when the flow tripping device 60 is a flange, the cross sectional shape may be similar to that shown in FIG. 3. The cross sectional shape may be round, or semi-circular as shown in the exemplary embodiment of the flow tripping device 66 of FIG. 4, such that a flow tripping device base 76 may be secured to either of the surfaces 25, 34 defining the annular chamber 30. In another exemplary embodiment shown in FIG. 5 the flow tripping device 68 may take a more aerodynamic shape such as a shape of a vane. In a particular embodiment the flow tripping device 68 may be in the form of a teardrop as shown in FIG. 5 with a trailing edge 79 on a combustor-inlet side of the flow tripping device 68. In the exemplary embodiment the of FIG. 5 the trailing edge 79 is concave, but in other exemplary embodiments the trailing edge 79 may be convex, flat, or may include any combination of shapes desired to form an aerodynamic vane shape. Any such aerodynamic shape that will result in a decreased pressure drop in the flow resulting from the presence of the flow tripping device 60 over that of a flow tripping device 60 with a square cross sectional area is considered within the scope of the invention.

Figure 6:
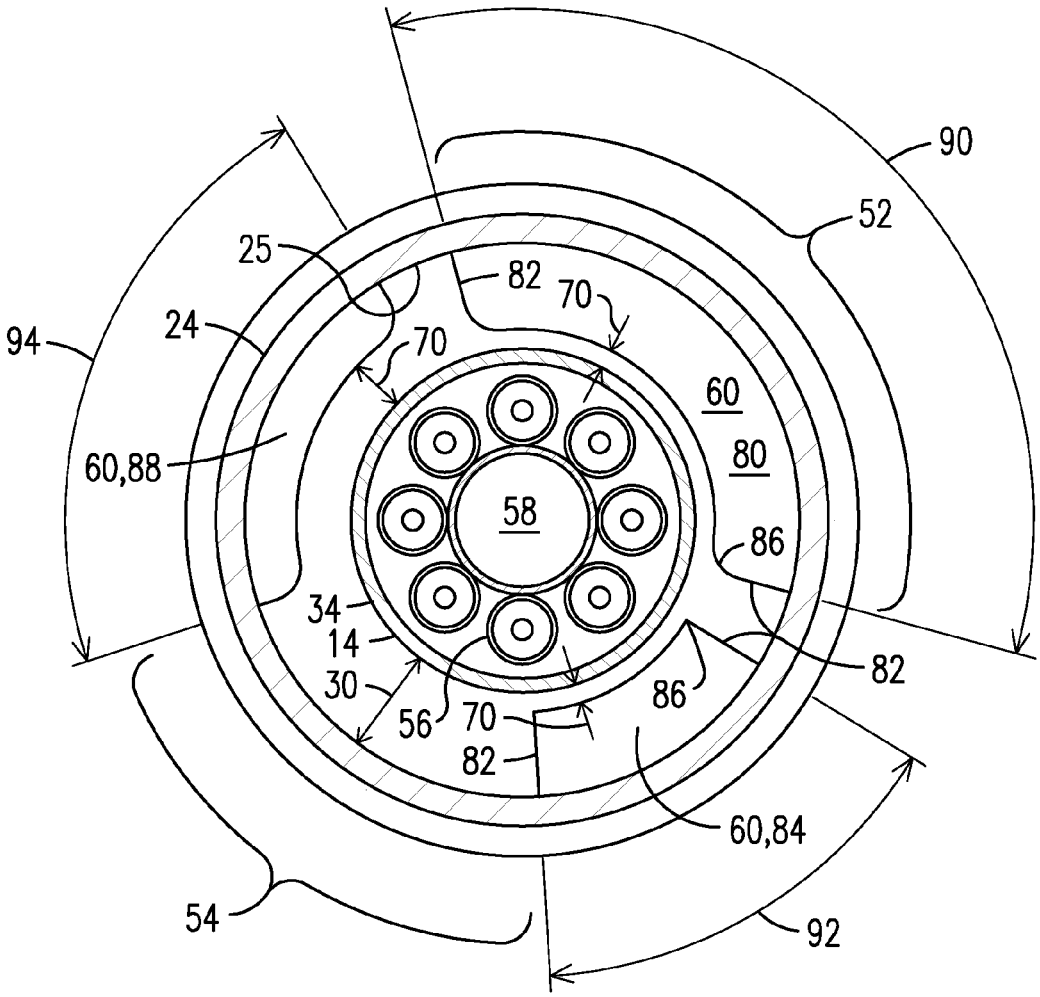
FIG. 6 is a cross section along line 2-2 of an alternate exemplary embodiment of FIG. 1

FIG. 6 is a cross section at line 2-2 of FIG. 1 of an alternate exemplary embodiment where several flow tripping devices 60 are used, each is elongated in a circumferential direction, and each spans less than the full circumference of the annular chamber 30, but at least an amount associated with an individual burner's portion of the circumference of the combustor. For example, if there are 8 burners disposed circumferentially, each would circumferentially span approximately 45 degrees of the circumference of the combustor can 14. Likewise then, a flow tripping device 60 may span approximately 45 degrees. Spanning an amount associated with an individual burner may be particularly useful for tuning the flow for each particular burner. For example, a first flow tripping device 80 may be disposed in the heavy flow region 52 upstream in the flow of compressed air from a heavy flow burner that receives a relatively heavy flow of compressed air from the heavy flow region 52. Such positioning may obstruct flow in the heavy flow region 52, and that might be used to circumferentially reapportion the flow to the lighter flow region 54 and burners adjacent to the heavy flow burner. In an alternate exemplary embodiment where there are more than eight burners, the flow tripping device 60 may be configured to span less than 45 degrees. For example, if there are 12 burners the flow tripping device may span $1/12^{th}$ the circumference, or 30 degrees. In yet another alternate exemplary embodiment where there are fewer than eight burners, the flow tripping device 60 may be configured to span more than 45 degrees. For example, if there are six burners, the flow tripping device 60 may span $1/6^{th}$ the circumference, or 60 degrees. Consequently, the first flow tripping device 80 may span any number of degrees from 360 degrees divided by the number of burners in the combustor can, up to 360 degrees.

Ends 82 of the first flow tripping device 80 may be rounded radially and/or circumferentially. Alternatively, in a second flow tripping device 84, the ends may be straight. Corners 86 of the flow tripping devices may be sharp or rounded. Both the first and second flow tripping devices 80, 82 leave relatively small gaps 70'. A third flow tripping device 88 may leave a much larger gap 70", and may span a circumferential distance shorter than that of the first flow tripping device 80, and longer than that of the second flow tripping device 84. Any combination of cross sectional heights and circumferential lengths may be used, as may any assortment of circumferential locations, and any combination of cross sectional shapes (i.e. tear drop, circular etc). Further, each of the flow tripping devices 80, 84, 88 may be disposed at different locations with respect to the combustor can longitudinal axis 74. For example, in an exemplary embodiment the first flow tripping device 80 may be more upstream with respect to the flow of compressed air (i.e. out of the page) than the second flow tripping device 84 and/or the third flow tripping device 88. This way the flow of compressed air can be guided circumferentially but with multiple devices, each serving its own role, to provide the desired net effect. It can be seen that in this manner the flow within the annular chamber can be more evenly distributed around the circumference so that the premix burners 56 approach equal flows, and also within the pilot burner 58 the flow is more uniform circumferentially.

It is expected in non ring shaped exemplary embodiments where there are circumferential ends 82, some of the air will move circumferentially while passing the ends, but when passing a first end the circumferential motion will be in a first direction, and when passing the second end the circumferential motion will be in a second, opposite direction, and this is merely a result of the presence of the flow tripping device 60 as opposed to a specifically imparted swirl.

In the exemplary embodiment of FIG. 6, the annular chamber 30 can be seen as having three separate cross sectional portions 90, 92, 94. Each cross sectional portion 90, 92, 94 is delimited by the ends 82 of the respective flow tripping devices 80, 84, 88. In an exemplary embodiment, within these cross sectional portions 90, 92, 94 the flow tripping devices 80, 84, 88, occupy at least 45% of the cross sectional area of the annular chamber just upstream of the device. The flow tripping device may extend to the point where it is almost spanning the entire distance across the annular chamber 30, but there is always a gap 70', 70" of some sort.

In light of the foregoing it is evident that the inventors have developed a very simple flow tripping device that is inexpensive to manufacture, costs virtually nothing to maintain, and offers a wide range of design versatility, yet reduces harmful emissions by up to 16%. Therefore, this represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A can annular combustion arrangement for a gas turbine engine, comprising:

a combustor can comprising a combustor can inlet and a burner, the combustor can defining a combustion zone therein downstream of a burner outlet;

an annular chamber surrounding the combustor can and comprising an inner dimension defined in part by an exterior surface of the combustor can for delivering a flow of compressed air from a plenum to the combustor can inlet;

a fuel injector disposed within the annular chamber and configured to inject a flow of fuel into the flow of compressed air; and a circumferentially continuous, ring shaped flow tripping device extending radially outward with respect to a combustor can longitudinal axis from the combustor can into the annular chamber transverse to a direction of the flow of compressed air, surrounding the combustor can, and disposed axially downstream of the fuel injector and along the combustor can longitudinal axis in a region bounded at one end by the burner outlet and at another end by the combustor can inlet, wherein the flow tripping device defines a narrowest gap between the flow tripping device and a second surface that defines a radially outward boundary of the annular chamber, and wherein at least a portion of an axial length along the combustor can longitudinal axis of the exterior surface of the combustor can between the combustor can inlet and the flow tripping device is characterized by a constant diameter.

2. The can annular combustion arrangement of claim 1, wherein the flow tripping device occupies at least 20% of a height of the annular chamber.

3. The can annular combustion arrangement of claim 1, wherein a height of the flow tripping device varies circumferentially.

4. The can annular combustion arrangement of claim 1, wherein the flow tripping device occupies at least 15% of a cross sectional area of the annular chamber.

5. The can annular combustion arrangement of claim 1, wherein the flow tripping device comprises a tear drop shape with a tapering end of the tear drop shape on a combustor-inlet side of the flow tripping device with respect to the direction of flow of the compressed air in the annular chamber.

6. The can annular combustion arrangement of claim 1, wherein the flow tripping device comprises a vane shaped cross section.

7. The can annular combustion arrangement of claim 1, wherein the flow tripping device comprises a curved leading edge presented to the flow of compressed air.

8. The can annular combustion arrangement of claim 1, wherein the flow tripping device is disposed closer to the inlet than to an outlet of the combustor can.

9. A gas turbine engine, comprising:

a can annular combustion assembly comprising a combustor can comprising a combustor inlet, a burner comprising a burner outlet, and defining a combustor can longitudinal axis:

an annular chamber surrounding and defined in part by an exterior surface of the combustor can; and an arcuate shaped flow tripping device extending into the annular chamber transverse to a direction of flow of compressed air in the annular chamber, disposed axially along the combustor can longitudinal axis in a region bounded by the burner outlet and the combustor can inlet, and circumferentially extending across a percentage of a circumference of the annular chamber, wherein the percentage is less than 100% and equals at least a quotient of 100 divided by a number of burners in the combustor can;

wherein the flow tripping device is disposed downstream of a fuel injector disposed within the annular chamber and configured to create a fuel/air mixture within the annular chamber.

10. The gas turbine engine of claim 9, wherein the flow tripping device is disposed in the annular chamber in a greater flow region of the circumference that experiences a relatively greater mass flow of compressed air when compared to a lesser mass flow region of the circumference, and wherein the flow tripping device is not present in the lesser mass flow region.

11. The gas turbine engine of claim 9, wherein the flow tripping device occupies at least 15% of a flow area of a circumferential portion of the annular chamber which the flow tripping device occupies.

12. The gas turbine engine of claim 9, wherein the flow tripping device comprises a vane-shaped cross section.

13. The gas turbine engine of claim 9, further comprising a plurality of flow tripping devices disposed at different locations in the annular chamber.

14. The gas turbine engine of claim 13, wherein the plurality of flow tripping devices are disposed at different axial locations with respect to the combustor can longitudinal axis.

15. The gas turbine engine of claim 9, wherein the flow tripping device defines an annular gap through which compressed air flows, and wherein at least a portion of an axial extension of the annular gap parallel to the combustor can longitudinal axis is unobstructed between the annular gap and the combustor can inlet.

16. A can annular combustion arrangement for a gas turbine engine, comprising:

a combustor can comprising a combustor can inlet, an exterior surface, a radially outward flare in the exterior surface at the combustor can inlet, and a burner;

an annular chamber surrounding the combustor can, comprising an inner dimension defined in part by the exterior surface of the combustor can, and configured to deliver a flow of compressed air from a plenum to the combustor can inlet;

a fuel injector disposed within the annular chamber configured to inject a flow of fuel into the flow of compressed air; and a circumferentially continuous, ring shaped flow tripping device extending radially outward with respect to a combustor can longitudinal axis from the combustor can into the annular chamber transverse to a direction of the flow of compressed aft, surrounding the combustor can, and disposed axially downstream of the fuel injector and along the combustor can longitudinal axis between the burner outlet and the flare, wherein the flow tripping device defines a gap between the flow tripping device and a second surface that defines a radially outward boundary of the annular chamber, and wherein the gap is a narrowest gap in the annular chamber.

* * * * *